US010219081B2

(12) United States Patent
Wernaers et al.

(10) Patent No.: US 10,219,081 B2
(45) Date of Patent: Feb. 26, 2019

(54) CONFIGURATION OF HEARING PROSTHESIS SOUND PROCESSOR BASED ON CONTROL SIGNAL CHARACTERIZATION OF AUDIO

(71) Applicant: Cochlear Limited, Macquarie University, NSW OT (AU)

(72) Inventors: Yves Wernaers, Teralfene (BE); Paul Carter, Sydney (AU)

(73) Assignee: Cochlear Limited, Macquarie University, NSW (AU)

( * ) Notice: Subject to any disclaimer, the term of this patent is extended or adjusted under 35 U.S.C. 154(b) by 0 days.

(21) Appl. No.: 15/601,373

(22) Filed: May 22, 2017

(65) Prior Publication Data

US 2017/0257711 A1 Sep. 7, 2017

Related U.S. Application Data

(63) Continuation of application No. 14/851,893, filed on Sep. 11, 2015, now abandoned.

(60) Provisional application No. 62/052,859, filed on Sep. 19, 2014.

(51) Int. Cl.
*H04R 25/00* (2006.01)

(52) U.S. Cl.
CPC ..... *H04R 25/505* (2013.01); *H04R 25/554* (2013.01); *H04R 25/558* (2013.01); *H04R 25/70* (2013.01); *H04R 2225/41* (2013.01); *H04R 2225/55* (2013.01)

(58) Field of Classification Search
CPC .... H04R 25/70; H04R 25/505; H04R 25/554; H04R 25/558; H04R 2225/55
USPC ..... 381/312, 313, 315, 328, 330
See application file for complete search history.

(56) References Cited

U.S. PATENT DOCUMENTS

| | | | |
|---|---|---|---|
| 7,853,030 | B2 | 12/2010 | Grasbon et al. |
| 8,768,479 | B1 | 7/2014 | Hood et al. |
| 2011/0255702 | A1 | 10/2011 | Jensen |
| 2012/0263329 | A1 | 10/2012 | Kjeldsen et al. |

(Continued)

FOREIGN PATENT DOCUMENTS

| | | | |
|---|---|---|---|
| WO | 2012066149 | A1 | 5/2012 |
| WO | 2013089693 | A1 | 6/2013 |

(Continued)

OTHER PUBLICATIONS

Extended European Search Report in EP Application No. 15 842 190.9, dated Mar. 27, 2018.

(Continued)

*Primary Examiner* — Brian Ensey
(74) *Attorney, Agent, or Firm* — Pilloff & Passino LLP; Martin J. Cosenza

(57) ABSTRACT

A method including receiving by a hearing prosthesis, from a device external to the hearing prosthesis, both audio content outputted by the device external to the hearing prosthesis and configurable prosthesis data outputted by the device external to the hearing prosthesis, the configurable prosthesis data being data usable by the prosthesis to configure itself to operate in a given manner and responsive to receipt of the configuration data, the hearing prosthesis automatically configuring a sound processor of the hearing prosthesis in a manner based at least in part on the configurable prosthesis data.

35 Claims, 4 Drawing Sheets

(56) References Cited

U.S. PATENT DOCUMENTS

| | | | | |
|---|---|---|---|---|
| 2013/0004000 | A1 | 1/2013 | Franck | |
| 2013/0085549 | A1 | 4/2013 | Case et al. | |
| 2013/0345775 | A1 | 12/2013 | Davidsson et al. | |
| 2014/0105433 | A1 | 4/2014 | Goorevich et al. | |
| 2014/0172042 | A1 | 6/2014 | Goorevich et al. | |
| 2015/0289062 | A1* | 10/2015 | Ungstrup ..... | H04R 25/554 381/314 |
| 2015/0289064 | A1* | 10/2015 | Jensen ..... | H04R 25/30 381/317 |
| 2016/0174001 | A1* | 6/2016 | Ungstrup ..... | H04R 25/505 381/315 |

FOREIGN PATENT DOCUMENTS

| | | | |
|---|---|---|---|
| WO | 2013189551 | A1 | 12/2013 |
| WO | 2014094859 | A1 | 6/2014 |

OTHER PUBLICATIONS

Dawn Chmielewski, "Next-Generation Hearing Aids Tune in to the iPhone," printed from the World Wide Web, https://recode.net/2014/04/18/next-generation-hearing-aids-tune-in-to-the-iphone/, dated Apr. 18, 2014.

Trulink, "Trulink connects Your Hearing Aids With Your iPhone," http://www.trulinkhearing.com/trulink-control-app#memories, printed from the World Wide Web on Jul. 2, 2018.

International Search Report and Written Opinion for PCT/IB2015/001962, dated Feb. 23, 2016.

International Search Report and Written Opinion for PCT/IB2015/001961, dated Feb. 23, 2016.

* cited by examiner

CONFIGURATION OF HEARING PROSTHESIS SOUND PROCESSOR BASED ON CONTROL SIGNAL CHARACTERIZATION OF AUDIO

REFERENCE TO RELATED APPLICATIONS

The present application is a Continuation Application of U.S. patent application Ser. No. 14/851,893, filed Sep. 11, 2015, naming Yves Wernaers as an inventor, which claims priority from U.S. Provisional Application No. 62/052,859, filed Sep. 19, 2014. The entire contents of these applications are incorporated herein by reference in their entirety.

BACKGROUND

Unless otherwise indicated herein, the description provided in this section is not prior art to the claims and is not admitted to be prior art by inclusion in this section.

Various types of hearing prostheses provide people having different types of hearing loss with the ability to perceive sound. Hearing loss may be conductive, sensorineural, or some combination of both conductive and sensorineural. Conductive hearing loss typically results from a dysfunction in any of the mechanisms that ordinarily conduct sound waves through the outer ear, the eardrum, or the bones of the middle ear. Sensorineural hearing loss typically results from a dysfunction in the inner ear, including the cochlea where sound vibrations are converted into neural signals, or any other part of the ear, auditory nerve, or brain that may process the neural signals.

People with some forms of conductive hearing loss may benefit from hearing devices such as hearing aids or electromechanical hearing devices. A hearing aid, for instance, typically includes at least one small microphone to receive sound, an amplifier to amplify certain portions of the detected sound, and a small speaker to transmit the amplified sounds into the person's ear. An electromechanical hearing device, on the other hand, typically includes at least one small microphone to receive sound and a mechanism that delivers a mechanical force to a bone (e.g., the recipient's skull, or middle-ear bone such as the stapes) or to a prosthetic (e.g., a prosthetic stapes implanted in the recipient's middle ear), thereby causing vibrations in cochlear fluid.

Further, people with certain forms of sensorineural hearing loss may benefit from hearing prostheses such as cochlear implants and/or auditory brainstem implants. Cochlear implant systems, for example, make use of at least one microphone (e.g., in an external unit or in an implanted unit) to receive sound and have a unit to convert the sound to a series of electrical stimulation signals, and an array of electrodes to deliver the stimulation signals to the implant recipient's cochlea so as to help the recipient perceive sound. Auditory brainstem implant systems use technology similar to cochlear implant systems, but instead of applying electrical stimulation to a person's cochlea, they apply electrical stimulation directly to a person's brain stem, bypassing the cochlea altogether, still helping the recipient perceive sound.

In addition, some people may benefit from hearing prostheses that combine one or more characteristics of the acoustic hearing aids, vibration-based hearing devices, cochlear implants, and auditory brainstem implants to enable the person to perceive sound.

SUMMARY

Hearing prostheses such as these or others may include a sound processor configured to process received audio input and to generate and provide corresponding stimulation signals that either directly or indirectly stimulate the recipient's hearing system. In practice, for instance, such a sound processor could be integrated with one or more microphones and/or other components of the hearing prosthesis and may be arranged to digitally sample the received audio input and to apply various digital signal processing algorithms so as to evaluate and transform the receive audio into appropriate stimulation output. In a hearing aid, for example, the sound processor may be configured to amplify received sound, filter out background noise, and output resulting amplified audio. Whereas, in a cochlear implant, for example, the sound processor may be configured to identify sound levels in certain frequency channels, filter out background noise, and generate corresponding stimulation signals for stimulating particular portions of the recipient's cochlea. Other examples are possible as well.

In general, the sound processor of a hearing prosthesis may be configured with certain operational settings that govern how it will process received audio input and provide stimulation output. By way of example, the sound processor may be configured to sample received audio at a particular rate, to apply certain gain tracking parameters so as to manage resulting stimulation intensity, to reduce background noise, to filter certain frequencies, and to generate stimulation signals at a particular rate. In some hearing prostheses, these or other sound-processor settings may be fixed. Whereas, in others, the settings may be dynamically adjusted based on real-time evaluation of the received audio, such as real-time detection of threshold noise or volume level in certain frequency channels for example.

The present disclosure provides for automated configuration of the sound processor of a hearing prosthesis in a manner that helps facilitate processing of audio coming from a device external to the hearing prosthesis ("external device"), such as a mobile phone, television, portable computer, or appliance, for instance. (In some embodiments, the external device is partially or fully implanted in the recipient of the hearing prosthesis.) The external device may be associated with the recipient of the hearing prosthesis, such as by being wirelessly paired with the recipient's hearing prosthesis, by being in local communication with a control unit that is also in local communication with the recipient's hearing prosthesis, by being owned or operated by or for the recipient, or otherwise by being in communication with the hearing prosthesis. And the hearing prosthesis may receive audio content being output by the external device.

In accordance with the disclosure, in addition to receiving audio content from the external device, the hearing prosthesis will receive from the external device a control signal that indicates one or more characteristics of the audio content being output by the external device (i.e., being output or about to be output), such as a specification of a dynamic range of the audio content, a specification of latency-sensitivity of the audio content, or various other characteristics of the audio. The hearing prosthesis may then respond to receipt of the control signal by automatically configuring its sound processor in a manner based at least in part on the indicated one or more characteristics of the audio content.

The control signal indicating the one or more characteristics of the audio content being output by the external device may expressly specify each such characteristic. Alternatively, the control signal could implicitly indicate the one or more characteristics of the audio content, such as by indicating that the external device is currently running a particular application of a type that would typically provide audio output having one or more particular characteristics.

Further, the control signal may provide the indication in any form that the hearing prosthesis would be configured to respond to as presently disclosed.

Accordingly, in one respect, disclosed herein is a method operable by a hearing prosthesis to facilitate such functionality. According to the method, the hearing prosthesis receives, from an external device, audio content being output by the external device. Further, the hearing prosthesis receives, from the external device, a control signal that indicates at least one characteristic of the audio content being output by the external device. In response to receipt of the control signal, the hearing prosthesis then automatically configures a sound processor of the hearing prosthesis in a manner based at least in part on the control signal indicating at least one characteristic of the audio content being output by the external device.

In another respect, disclosed is a method also operable by a hearing prosthesis. According to the method, the hearing prosthesis receives, from an external device associated with a recipient of the hearing prosthesis, a control signal specifying one or more characteristics of audio content being output by the external device. In turn, responsive to receipt of the control signal, the hearing prosthesis then (i) determines from the control signal the one or more characteristics of the audio content being output by the external device, and (ii) automatically configures a sound processor of the hearing prosthesis based at least in part on the determined one or more characteristics of the audio content.

Further, in still another respect, disclosed is a hearing prosthesis that includes at least one microphone for receiving audio, a sound processor for processing the audio and generating corresponding hearing stimulation signals to stimulate hearing in a human recipient of the hearing prosthesis, and a wireless communication interface. In practice, the hearing prosthesis is configured to receive from an external device, via the wireless communication interface, a control signal indicating at least one attribute of the audio, and to respond to the received control signal by automatically configuring the sound processor in a manner based at least in part on the control signal indicating the at least one attribute of the audio.

In addition, in yet another respect, disclosed is a system that includes a hearing prosthesis and a handheld and/or mobile computing device associated with a recipient of the hearing prosthesis. In the disclosed system, hearing prosthesis includes a sound processor for processing received audio input and generating hearing stimulation signals for the recipient of the hearing prosthesis. Further, the computing device is configured to output audio content, and the computing device is configured to transmit to the hearing prosthesis a control signal indicating one or more attributes of the audio content. And the hearing prosthesis is configured to automatically configure its sound processor in a manner based at least in part on the control signal indicating the one or more attributes of the audio content. The computing device may be configured to transmit the control signal separately from the audio input such that the hearing prosthesis receives the control signal separately from the audio input, or may be configured to transmit the audio content and control signal integrated together such that the hearing prosthesis is configured to receive the audio content and control signal integrated together. The computing device may be configured to output the audio input as sound from an audio speaker and also configured to transmit the control signal over a radio frequency (RF) air interface such that the hearing prosthesis is configured to receive the audio input at a microphone and the control signal at an RF receiver.

These as well as other aspects, advantages, and alternatives will become apparent to those of ordinary skill in the art by reading the following detailed description, with reference where appropriate to the accompanying drawings. Further, it should be understood that the description throughout by this document, including in this summary section, is provided by way of example only and therefore should not be viewed as limiting.

DETAILED DESCRIPTION

Figure 1:
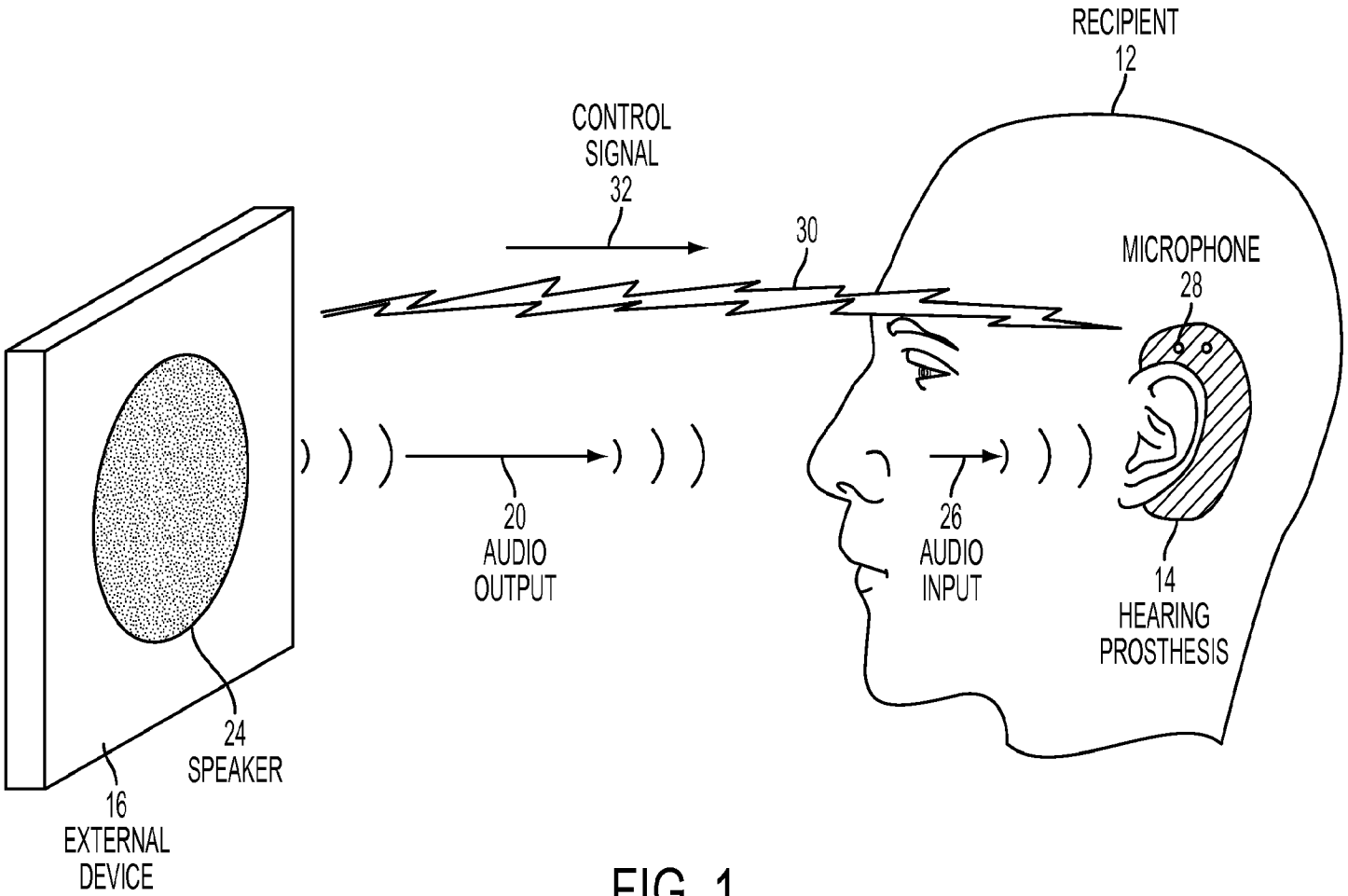
FIG. 1 is a simplified illustration of an example system in which features of the present disclosure can be implemented.

Referring to the drawings, as noted above, FIG. 1 is a simplified illustration of an example system in which features of the present disclosure can be implemented. In particular, FIG. 1 depicts a hearing prosthesis recipient 12 fitted with a hearing prosthesis 14, and further depicts an external device 16 that is providing audio output 20 from a speaker 24. As shown, the audio output from the speaker of the external device is arriving as audio input 26 at a microphone or other sensor 28 of the hearing prosthesis, so that the hearing prosthesis may receive and process the audio input to stimulate hearing by the recipient.

It should be understood that the arrangement shown in FIG. 1 is provided only as an example, and that many variations are possible. For example, although the figure depicts the external device providing audio output from a speaker and the audio output arriving as audio input at the ear of the recipient, the external device could instead provide audio to the hearing prosthesis through wireless data communication, such as through a BLUETOOTH link between a radio in the external device and a corresponding radio in the hearing prosthesis. Alternatively, the external device may provide audio to the hearing prosthesis through one or more separate speakers, possibly remote from the external device itself. Further, as another example, although the figure depicts the hearing prosthesis with an external behind-the-ear component, which could include one or more microphones and a sound processor, the hearing prosthesis 14 could take other forms, including possibly being fully implanted in the recipient and thus having one or more microphones and a sound processor implanted in the recipient rather than being provided in an external component. Other examples are possible as well.

In line with the discussion above, the external device in this arrangement may be associated with the recipient of the hearing prosthesis, such as by having a defined wireless communication link 30 with the hearing prosthesis for instance. In practice, such a link could be a radio-frequency link or an infrared link, and could be established using any of a variety of air interface protocols, such as BLUETOOTH, WIFI, or ZIGBEE for instance. As such, the external device and the hearing prosthesis could be wirelessly paired with each other through a standard wireless pairing procedure or could be associated with each other in some other manner, thereby defining an association between external device and the recipient of the hearing prosthesis. Alternatively, the external device could be associated with the recipient of the hearing prosthesis in another manner.

FIG. 1 additionally depicts a control signal 32 passing over the wireless communication link from the external device to the hearing prosthesis. In accordance with the present disclosure, such a control signal may provide the hearing prosthesis with an indication of one or more characteristics of the audio content being output by the external device. As noted above, the hearing prosthesis would then respond to such an indication by configuring one or more operational settings of its sound processor, optimally to accommodate processing of the audio that is arriving from the external device.

In practice, the control signal indication of the one or more characteristics of the audio content being output by the external device could be an express specification of the one or more characteristics, such as a code, text, or one or more other values that the hearing prosthesis is programmed to interpret as specifying one or more particular audio characteristics, or at least to which the hearing prosthesis is programmed to respond by configuring its sound processor in a manner appropriate for when the audio has such characteristic(s), to help facilitate processing of the audio coming from the external device.

Alternatively or additionally, the control signal indication of the one or more characteristics of the audio content being output by the external device could be an implicit indication of such characteristic(s). By way of example, considering that certain audio content or types of audio content (e.g., streaming audio, telephone audio, gaming audio, particular songs, particular speech, etc.) may each typically have certain associated characteristics, the external device could implicitly indicate one or more characteristics of the audio content by indicating the audio content type of audio content being output. The hearing prosthesis could then be configured to correlate the indicated audio content or type of audio content with one or more associated audio characteristics, or at least to respond by configuring its sound processor in a manner appropriate for when the audio has such characteristic(s).

As another example, if the external device is configured to run various program applications that may generally, or in particular states, typically play audio content having particular characteristics (e.g., a telephone application that outputs telephone audio with limited dynamic range, a gaming application that outputs gaming audio that is latency-sensitive, etc.), the external device could implicitly indicate one or more characteristics of the audio content by indicating an application or type of application that the external device is currently running, perhaps specifically when such an application is in a mode where it is currently outputting such audio content. The hearing prosthesis may then be configured to correlate the indication of that application or type of application with one or more associated audio characteristics, or at least to respond by configuring its sound processor in a manner appropriate for when the audio has such characteristic(s).

Thus, the external device could be programmed to detect when it is outputting audio and/or when it is running an application that outputs or is outputting audio, and to responsively transmit to the hearing prosthesis a control signal that indicates one or more characteristics of that audio. And the hearing prosthesis may be configured to receive and respond to such a control signal by automatically configuring its sound processor to help accommodate processing of such audio, and to thereby help the recipient to perceive the audio.

By way of example, if the external device is currently outputting audio content with a large dynamic range, such as music or a video soundtrack encoded with an uncompressed audio format or the like, the external device may indicate so in its control signal to the hearing prosthesis, such as by specifying the dynamic range, or by specifying the type of audio content and/or the application outputting the audio content, in a manner to which the hearing prosthesis would be programmed to respond by setting its sound processor to help optimize processing of such audio. Upon receipt of such a control signal indication, and based at least in part on the indication of the dynamic range of the audio content being output by the external device, the hearing prosthesis may then configure its sound processor accordingly. For instance, the hearing prosthesis may responsively set its sound processor to adjust one or more parameters of an automatic gain control (AGC) algorithm that it applies, such as to apply faster gain-tracking speed or otherwise to adjust gain-tracking speed, and/or to set attack-time, release-time, kneepoint(s), and/or other AGC parameters in a manner appropriate for the indicated dynamic range. Further, the hearing prosthesis may responsively set its sound processor to configure one or more frequency filter settings, such as to apply a wide band-pass filter or no band-pass filter, to accommodate input of audio in the indicated frequency range.

As another example, if the external device is currently outputting audio content that is primarily speech content, such as voice call audio or video-conference audio for instance, the external device may indicate so in its control signal to the hearing prosthesis, and, based at least in part on the indication that the audio content is primarily speech content, the hearing prosthesis may responsively set its sound processor to improve intelligibility of the speech. Whereas, if the external device is currently outputting audio content that is not primarily speech content, such as music or video soundtrack content, the external device may indicate so in its control signal, and, based at least in part on that indication, the hearing prosthesis may responsively set its sound processor to improve appreciation of music.

Further, if the external device is currently engaged in a voice call and is or will be outputting associated voice call audio, the device may indicate so in its control signal to the hearing prosthesis, and, based at least in part on that indication, the hearing prosthesis may responsively set its sound processor to process audio content of that type, such as to apply a band-pass filter covering a frequency range typically associated with the voice call audio. For instance, the external device may indicate generally that it is engaged in a voice call or that it is or will be outputting voice call audio, and the hearing prosthesis may responsively set its sound processor to apply a band-pass filter covering a range of about 0.05 kHz to 8 kHz to help process that audio. Further, the external device may indicate more specifically a type of voice call in which it is engaged or a type of voice call audio that it is or will be outputting, and the hearing prosthesis may set its sound processor to apply an associated band-pass filter based on the indicated type. Such an arrangement could help accommodate efficient processing of various types of voice call audio, such as POTS calls (e.g., with a band-pass filter spanning 0.3 kHz to 3.4 kHz), an HD voice call (e.g., with a band-pass filter spanning 0.05 kHz to 7 kHz), and a voice-over-IP call (e.g., with a band-pass filter spanning 0.05 kHz to 8 kHz).

In addition, if the external device is currently outputting audio content with a limited dynamic range (e.g., AM radio), the external device may indicate so in its control signal to the hearing prosthesis, and, based at least in part on that indication, the hearing prosthesis may responsively set its sound processor to process audio content of that type. For instance, the hearing prosthesis may responsively configure its sound processor with particular AGC parameters, such as to apply slower gain tracking.

As still another example, if the external device is currently outputting audio content that is encoded with a particular codec (e.g., G.723.1, G.711, MP3, etc.), the device may indicate so in its control signal to the hearing prosthesis, and, based at least in part on that indication, the hearing prosthesis may responsively set its sound processor to process audio content of that type. For instance, the hearing prosthesis may responsively configure its sound processor to apply a band-pass filter having a particular frequency range typically associated with the audio codec. Alternatively or additionally, if the codec is of limited dynamic range, the hearing prosthesis may configure its sound processor to process the incoming audio with fewer DSP clock cycles (e.g., to disregard certain least significant bits of incoming audio samples) and/or to power off certain DSP hardware, which may provide DSP power savings as well. Or the hearing prosthesis may otherwise modify the extent of digital signal processing by its sound processor.

Further, as yet another example, if the external device is currently outputting latency-sensitive audio content, such as if the device is currently running a gaming application and particularly a gaming application including output of gaming audio content, where speed of audible interaction may be important, the device may indicate so in its control signal to the hearing prosthesis, and, based at least in part on that indication, the hearing prosthesis may responsively set its sound processor to reduce or eliminate typical process steps that contribute to latency of sound processing, so as to help reduce latency of sound processing. For instance, the hearing-prosthesis may responsively set its sound processor to reduce its rate of digitally sampling the audio input (such as by reprogramming one or more filters to relax sensitivity (e.g., by increasing roll-off, reducing attenuation, and/or increasing bandwidth) so as to reduce the number of filter taps), which may reduce the frequency resolution but which may also may reduce the extent of data buffering and thereby reduce latency of sound processing. Alternatively, the hearing prosthesis could otherwise modify its sampling rate (possibly increasing the sample rate, if that may help to reduce latency.) Alternatively or additionally, the hearing prosthesis could set its sound processor to eliminate or bypass one or more frequency filters, which typically require data buffering.

Further, as yet another example, there are in some embodiments a set of maps available to the hearing prosthesis (e.g., stored on a memory associated with the hearing prosthesis). Each map in the set of maps is associated with a specific type of output from the external device. Also, each map is customized for a specific recipient and governs certain signal processing functions of the hearing prosthesis. A map is typically set by an audiologist while fitting the hearing prosthesis to the recipient. In response to a given output from the external device or an indication of such output from the external device, the hearing prosthesis can access and enable the map associated with such output for the recipient.

Numerous other examples of audio output characteristics are possible as well. Generally, the external device may be programmed with data indicating the characteristics of its audio output and/or may be configured to analyze its audio output to dynamically determine its characteristics. The external device may then programmatically generate and transmit to the hearing prosthesis a control signal that indicates such characteristics, in a manner that the hearing prosthesis would be programmed to interpret and to which the hearing prosthesis would be programmed to respond as discussed above.

As the external device detects changes in factors such as those discussed above (e.g., changes in the state or a characteristic of audio content output by the external device, etc.), the external device may transmit updated control signals to the hearing prosthesis, and the hearing prosthesis may respond to each such control signal by changing its sound-processor settings accordingly.

Further, in certain situations (e.g., depending on state of the external device), the external device may transmit to the hearing prosthesis a control signal that causes the hearing prosthesis to revert to its original sound-processor settings or to adopt sound-processor settings it might otherwise have at a given moment. For instance, if the external device had responded to a particular trigger condition (e.g., output of particular audio content and/or one or more other factors such as those discussed above) by transmitting to the hearing prosthesis a control signal that causes the hearing prosthesis to adjust its sound-processor settings as discussed above, the external device may thereafter detect an end of the trigger condition (e.g., discontinuation of its output of the audio content, engaging in a power-down routine, or the like) and may responsively transmit to the hearing prosthesis a control signal that causes the hearing prosthesis to undo its sound processor adjustments or adopt sound-processor settings it might otherwise have at a given moment.

In addition, the external device may periodically transmit to the hearing prosthesis control signals like those discussed above. For instance, the external device may be configured to transmit an updated control signal to the hearing prosthesis every 250 milliseconds. To help ensure that a sound processor adjustment would be appropriate (e.g., to help avoid making sound processor adjustments and then shortly thereafter undoing those adjustments), the hearing prosthesis could then be configured to require a certain threshold duration or sequential quantity of control signals (e.g., 2 seconds or 8 control signals in a row) providing the same indication as each other, as a condition for the hearing prosthesis to then make the associated sound processor adjustment. Further, the hearing prosthesis could be configured to detect an absence of any control signals from the external device (e.g., a threshold duration of not receiving any such control signals and/or non-receipt of a threshold sequential quantity of control signals) and, in response, to automatically revert to its original sound-processor configuration or enter a sound-processor configuration it might otherwise have at a given moment. Moreover, the hearing prosthesis and/or external device may be configured to allow user-overriding of any control signaling or sound processor adjustments.

The external device and/or hearing prosthesis could also be arranged to not engage in aspects of this process in certain scenarios, such as when the change in characteristic of audio output from the external device would be short lived. For instance, if the external device is outputting or is going to output a very short piece of audio, the external device could be configured to detect that (e.g., based on the type of audio being output or based on other considerations) and to responsively forgo sending an associated control signal to the hearing prosthesis, to help avoid having the prosthesis make a change to sound-processor configuration that would be shortly thereafter undone. Alternatively, the external device could be configured to detect that and to responsively transmit to the hearing prosthesis a control signal that indicates the transient nature of the audio output, in which case the hearing prosthesis could then responsively not adjust its sound-processor configuration. Still alternatively, the hearing prosthesis could be configured to apply reduced or less noticeable sound processor adjustments (e.g., a reduced extent of filter adjustment or AGC adjustment, etc.) in response to a control signaling from the external device indicating that audio output from the external device is likely to be short-lived.

The control signal that the external device transmits to the hearing prosthesis in accordance with the present disclosure can take any of a variety of forms. Optimally, the control signal would provide one or more indications as discussed above in any way that the hearing prosthesis would be configured to interpret and to which the hearing prosthesis would be configured to respond accordingly. By way of example, both the external device and the hearing prosthesis could be provisioned with data that defines codes, values, or the like to represent particular characteristics of audio output from the external device. Thus, the external device may use such codes, values or the like to provide one or more indications in the control signal, and the hearing prosthesis may correspondingly interpret the codes, values, or the like, and respond accordingly. Moreover, such a control signal may actually comprise one or more control signals that cooperatively provide the desired indication(s).

In addition, the external device can transmit the control signal to the hearing prosthesis in any of a variety of ways. For instance, in the arrangement of FIG. 1, where the external device has a speaker providing the audio output, the external device could transmit the control signal to the hearing prosthesis separate and apart from the audio output, over its wireless communication link with the hearing prosthesis for example. As such, the control signal could be encapsulated in an applicable wireless link communication protocol for wireless transmission, and the hearing prosthesis could receive the transmission, strip the wireless link encapsulation, and uncover the control signal.

Alternatively, the external device could integrate the control signal with its audio output in some manner. For instance, the external device could modulate the control signal on an audio frequency that is outside the range the hearing prosthesis would normally process for hearing stimulation, but the hearing prosthesis, such as its sound processor, could be arranged to detect and demodulate communication on that frequency so as to obtain the control signal.

Further, in an alternative arrangement, the external device may be arranged to transmit audio to the hearing prosthesis via the wireless communication link 30, e.g., as a digital audio stream, and the hearing prosthesis may be arranged to receive the transmitted audio and to process the audio in much the same way that the hearing prosthesis would process analog audio input received at one or more microphones, possibly without a need to digitally sample, or with an added need to transcode the audio signal. In such an arrangement, the external device could provide the control signal as additional data, possibly multiplexed or otherwise integrated with the audio data, and the hearing prosthesis could be arranged to extract the control signal from the received data.

Note also that the control signal transmission from the external device to the hearing prosthesis could pass through one or more intermediate nodes. For instance, the external device could transmit the control signal to another device associated with the recipient of the hearing prosthesis, and that other device could then responsively transmit the control signal to the hearing prosthesis. This arrangement could work well in a scenario where the hearing prosthesis interworks with a supplemental processing device of some sort, as the external device could transmit the control signal to that supplemental device, and the supplemental device could transmit the control signal in turn to the hearing prosthesis.

In addition, note that the audio output from the external device could come directly from the external device as shown in FIG. 1 or could come from another location. By way of example, the external device could transmit audio to a remotely positioned speaker or other device, which could then output the audio (e.g., as acoustic audio output or through RF wireless transmission as discussed above) for receipt in turn by the hearing prosthesis.

Figure 2:
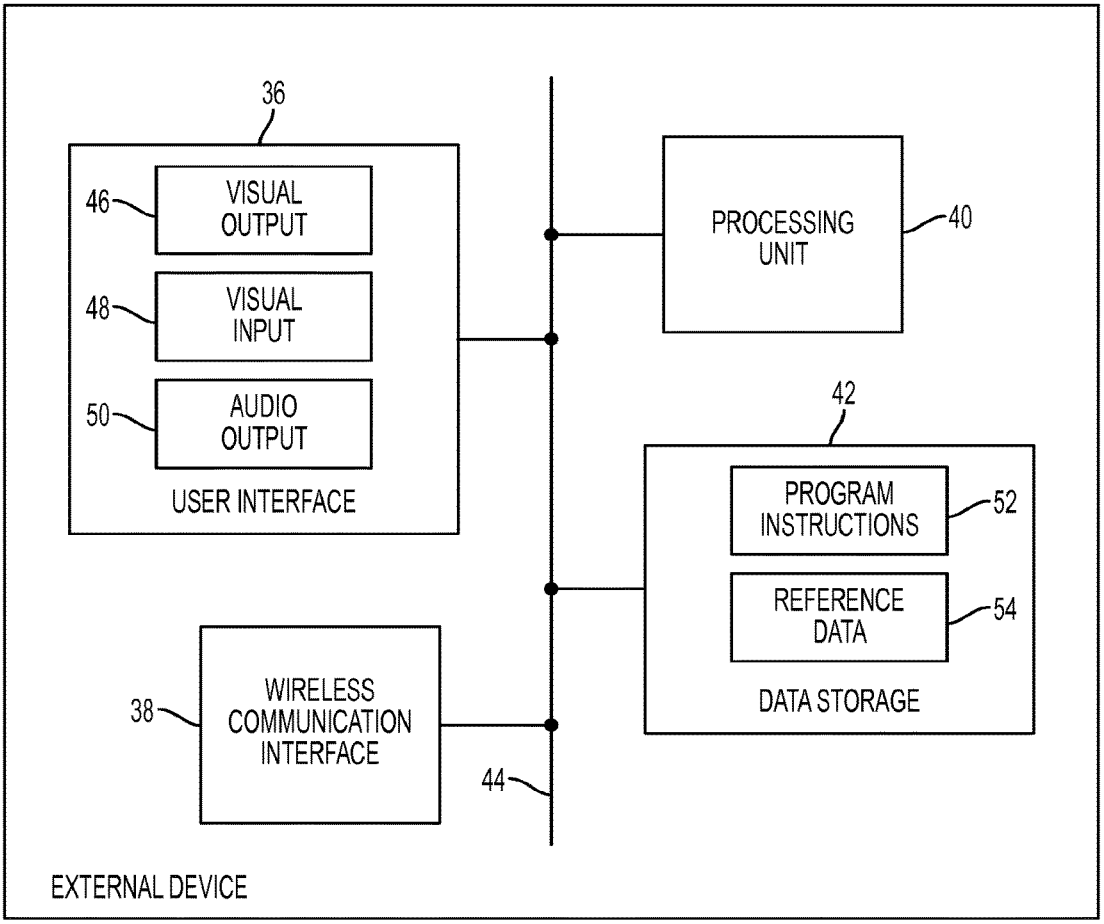
FIG. 2 is a simplified block diagram depicting components of an example external device.

In practice, the external device could be any of a variety of handheld and/or mobile computing devices or other devices, examples of which include a cellular telephone, a camera, a gaming device, an appliance, a tablet computer, a desktop or portable computer, a television, a movie theater, a smartwatch, or another sort of device or combination of devices (e.g., phones, tablets, or other devices docked with laptops or coupled with various types of external audio-visual output systems) now known or later developed. FIG. 2 is a simplified block diagram showing some of the components that could be included in such an external device to facilitate carrying out various functions as discussed above. As shown in FIG. 2, the example external device includes a user interface 36, a wireless communication interface 38, a processing unit 40, and data storage 42, all of which may be communicatively linked together by a system bus, network, or other connection mechanism 44.

With this arrangement as further shown, user interface 36 may include a visual output interface 46, such as a display screen or projector configured to present visual content, or one or more components to providing visual output of other types. Further, the user interface may include a visual input interface 48, such as a video camera. In addition, the user interface may include an audio output interface 50, such as a sound speaker or digital audio output circuit configured to provide audio output that could be received and processed as audio input by the recipient's hearing prosthesis.

The wireless communication interface 38 may then comprise a wireless chipset and antenna, arranged to pair with and engage in wireless communication with a corresponding wireless communication interface in the hearing prosthesis according to an agreed protocol such as one of those noted above. For instance, the wireless communication interface could be a BLUETOOTH radio and associated antenna or an infrared transmitter, or could take other forms.

Processing unit 40 may then comprise one or more processors (e.g., application specific integrated circuits, or programmable logic devices, etc.) Further, data storage 42 may comprise one or more volatile and/or non-volatile storage components, such as magnetic, optical, or flash storage and may be integrated in whole or in part with processing unit 40. As shown, data storage 42 may hold program instructions 52 executable by the processing unit to carry out various external device functions described herein, as well as reference data 54 that the processing unit may reference as a basis to carry out various such functions.

By way of example, the program instructions may be executable by the processing unit to facilitate wireless pairing of the external device with the hearing prosthesis. Further, the program instructions may be executable by the processing unit to detect that the external device is outputting (i.e., is currently outputting or is about to output) audio output having one or more particular characteristics, and to responsively generate and transmit to the hearing prosthesis a control signal providing one or more indications as discussed above, to cause the hearing prosthesis to configure its sound processor accordingly. As noted above, for instance, the external device could provide such a control signal through its wireless communication link with the hearing prosthesis, or through modulation of an analog audio output for instance.

Figure 3:
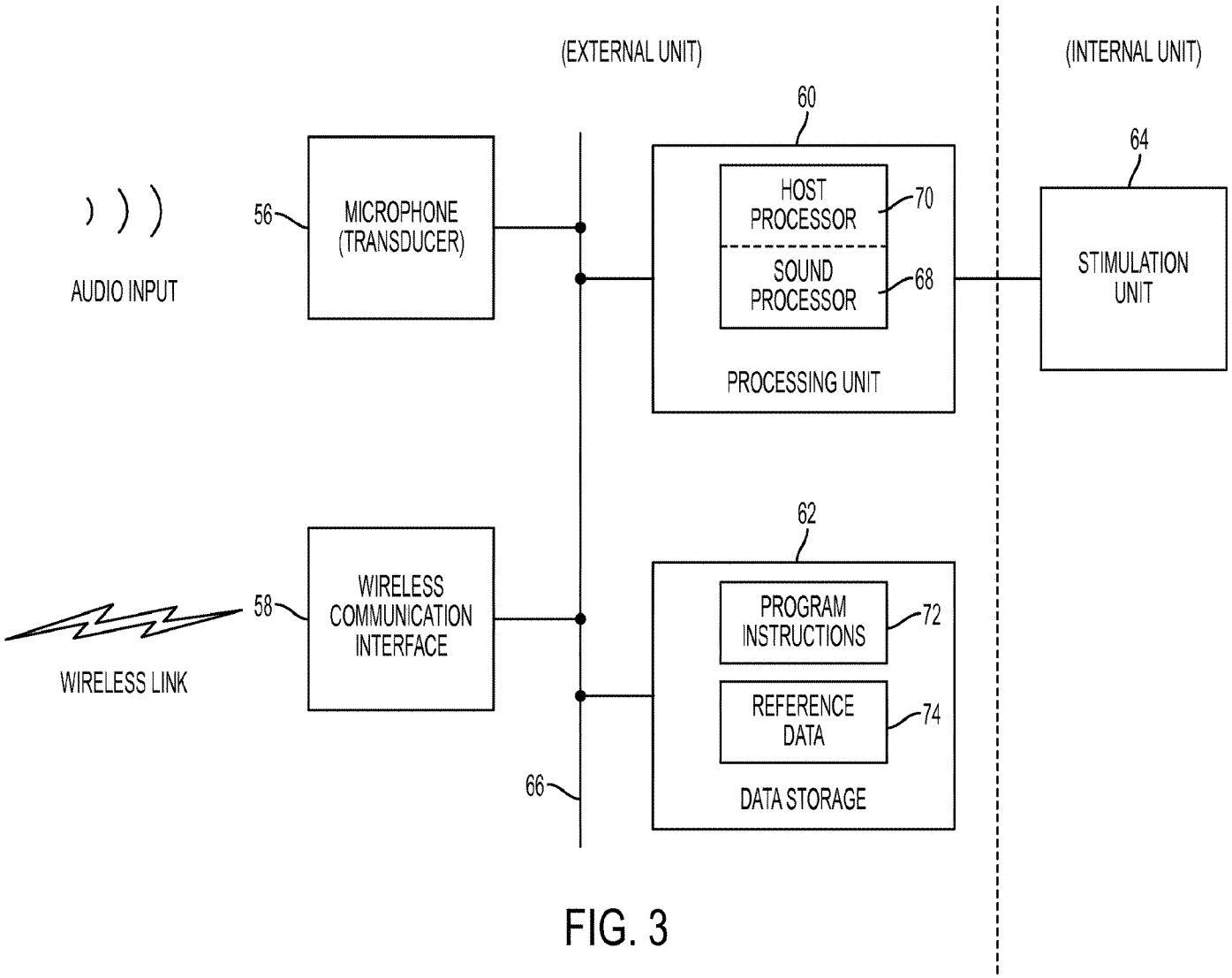
FIG. 3 is a simplified block diagram depicting components of an example hearing prosthesis.

The hearing prosthesis, in turn, can also take any of a variety of forms, examples of which include, without limitation, those discussed in the background section above. FIG. 3 is a simplified block diagram depicting components of such a hearing prosthesis to facilitate carrying out various functions as described above.

As shown in FIG. 3, the example hearing prosthesis includes a microphone (or other audio transducer) 56, a wireless communication interface 58, a processing unit 60, data storage 62, and a stimulation unit 64. In the example arrangement, the microphone 56, wireless communication interface 58, processing unit 60, and data storage 62 are communicatively linked together by a system bus, network, or other connection mechanism 66. Further, the processing unit is then shown separately in communication with the stimulation unit 64, although in practice the stimulation unit could also be communicatively linked with mechanism 66.

Depending on the specific hearing prosthesis configuration, these components could be provided in or more physical units for use by the recipient. As shown parenthetically and by the vertical dashed line in the figure, for example, the microphone 56, wireless communication interface 58, processing unit 60, and data storage 62 could all be provided in an external unit, such as a behind-the-ear unit configured to be worn by the recipient, and the stimulation unit 64 could be provided as an internal unit, such as a unit configured to be implanted in the recipient for instance. With such an arrangement, the hearing prosthesis may further include a mechanism, such as an inductive coupling, to facilitate communication between the external unit and the external unit. Alternatively, as noted above, the hearing prosthesis could take other forms, including possibly being fully implanted, in which case some or all of the components shown in FIG. 3 as being in a unit external to the recipient could instead be provided internal to the recipient. Other arrangements are possible as well.

In the arrangement as shown, the microphone 56 may be arranged to receive audio input, such as audio coming from the external device as discussed above, and to provide a corresponding signal (e.g., electrical or optical, possibly sampled) to the processing unit 60. Further, microphone 56 may comprise multiple microphones or other audio transducers, which could be positioned on an exposed surface of a behind-the-ear unit as shown by the dots on the example hearing prosthesis in FIG. 1. Use of multiple microphones like this can help facilitate microphone beamforming in the situations noted above for instance.

Wireless communication interface 58 may then comprise a wireless chipset and antenna, arranged to pair with and engage in wireless communication with a corresponding wireless communication interface in another device such as the external device discussed above, again according to an agreed protocol such as one of those noted above. For instance, the wireless communication interface 58 could be a BLUETOOTH radio and associated antenna or an infrared receiver, or could take other forms.

Further, stimulation unit 64 may take various forms, depending on the form of the hearing prosthesis. For instance, if the hearing prosthesis is a hearing aid, the stimulation unit may be a sound speaker for providing amplified audio. Whereas, if the hearing prosthesis is a cochlear implant, the stimulation unit may be a series of electrodes implanted in the recipient's cochlea, arranged to deliver stimuli to help the recipient perceive sound as discussed above. Other examples are possible as well.

Processing unit 60 may then comprise one or more processors (e.g., application specific integrated circuits, programmable logic devices, etc.) As shown, at least one such processor functions as a sound processor 68 of the hearing prosthesis, to process received audio input so as to enable generation of corresponding stimulation signals as discussed above. Further, another such processor 70 of the hearing prosthesis could be configured to receive a control signal via the wireless communication interface or as modulated audio as discussed above and to responsively configure or cause to be configured the sound processor 68 in the manner discussed above. Alternatively, all processing functions, including receiving and responding to the control signal, could be carried out by the sound processor 68 itself.

Data storage 62 may then comprise one or more volatile and/or non-volatile storage components, such as magnetic, optical, or flash storage, and may be integrated in whole or in part with processing unit 60. As shown, data storage 62 may hold program instructions 72 executable by the processing unit 60 to carry out various hearing prosthesis functions described herein, as well as reference data 74 that the processing unit 60 may reference as a basis to carry out various such functions.

By way of example, the program instructions 72 may be executable by the processing unit 60 to facilitate wireless pairing of the hearing prosthesis with the external device. Further, the program instructions may be executable by the processing unit 60 to carry out various sound processing functions discussed above including but not limited to sampling audio input, applying frequency filters, and applying automatic gain control, and outputting stimulation signals, for instance. Many such sound processing functions are known in the art and therefore not described here. Optimally, the sound processor 68 may carry out many of these functions in the digital domain, applying various digital signal processing algorithms with various settings to process received audio and generate stimulation signal output. However, certain sound processor functions, such as particular filters, for instance, could be applied in the analog domain, with the sound processor 68 programmatically switching such functions on or off (e.g., into or out of an audio processing circuit) or otherwise adjusting configuration of such functions.

Figure 4:
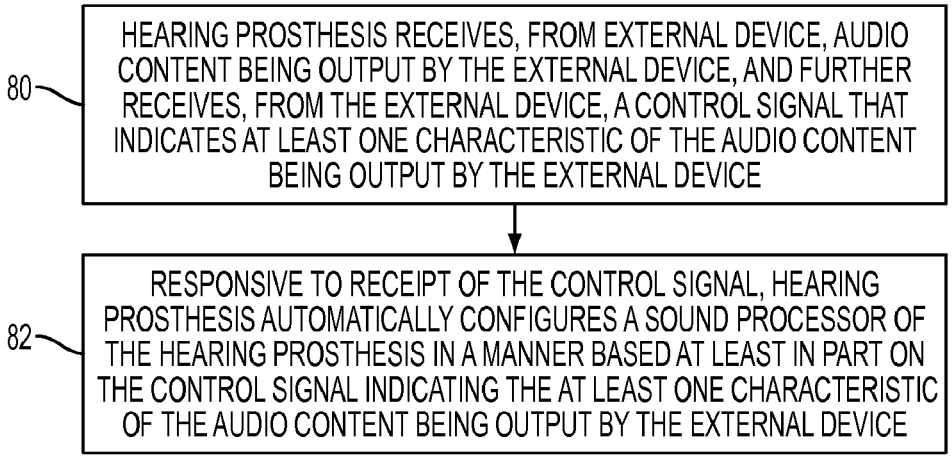
FIG. 4 is a flow chart depicting functions that can be carried out in accordance with the present disclosure.

FIG. 4 is next a flow chart depicting functions that can be carried out in accordance with the discussion above, to facilitate automated configuration of a hearing prosthesis sound processor based on a control signal characterization of audio. As shown in FIG. 4, at block 80, processing unit 60 of the hearing prosthesis receives, from an external device, audio content being output by the external device and further receives, from the external device, a control signal that indicates at least one characteristic of the audio content being output by the external device. In turn, at block 82, responsive to receipt of the control signal, the hearing prosthesis then automatically configures a sound processor of the hearing prosthesis in a manner based at least in part on the control signal indicating the at least one characteristic of the audio content being output by the external device.

In line with the examples discussed above, the act of receiving the audio content from the external device in this method may involve receiving at a microphone of the hearing prosthesis audio content comprising sound output from a speaker of the external device, or receiving the audio content through radio-frequency data communication from the external device. Further, the act of receiving the control signal from the external device may involve receiving the control signal through radio-frequency data communication from the external device, or receiving the control signal modulated on an audio signal from the external device. As such, or in other arrangements, the audio content and control signal could be separate from each other, in which case receiving the control signal could be separate from receiving the audio content. Alternatively, the audio content and control signal could be integrated together (e.g., both on a radio frequency wireless interface, perhaps with one in a header of another or multiplexed together or the like), in which case the receiving of the control signal could be integrated with the receiving of the audio content (e.g., by receiving one radio-frequency or audio signal and then separating the control signal and audio for respective processing).

Figure 5:
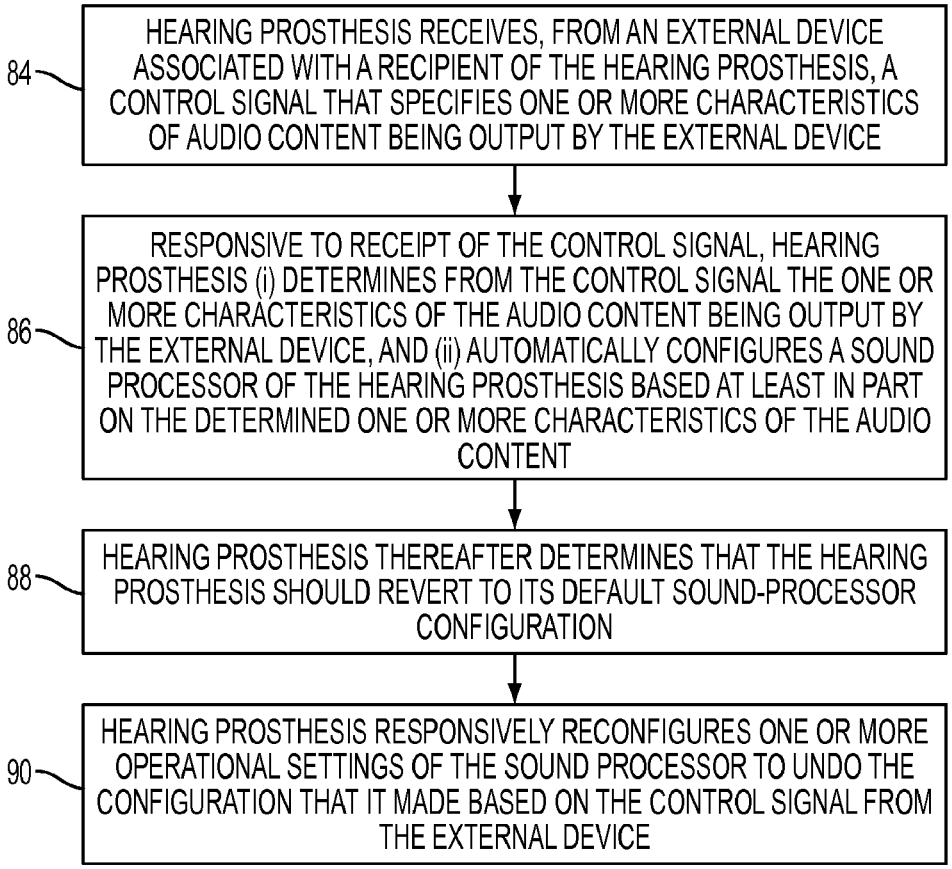
FIG. 5 is another flow chart depicting functions that can be carried out in accordance with the disclosure.

Finally, FIG. 5 is another flow chart depicting functions that can be carried out in accordance with the present disclosure. As shown in FIG. 5, at block 84, a hearing prosthesis receives, from an external device associated with a recipient of the hearing prosthesis, a control signal that specifies one or more characteristics of audio content being output by the external device. At block 86, responsive to receipt of the control signal, the hearing prosthesis then (i) determines from the control signal the one or more characteristics of the audio content being output by the external device, and (ii) automatically configures a sound processor of the hearing prosthesis based at least in part on the determined one or more characteristics of the audio content.

In practice, for example, upon receipt of the control signal, the hearing prosthesis may read the received control signal to determine what the control signal indicates, such as one or more particular audio characteristics. The hearing prosthesis may then make a determination, based at least in part on the indication(s) provided by the control signal, of one or more corresponding sound-processor configuration settings for the hearing prosthesis. The hearing prosthesis may then automatically configure (e.g., set, adjust, or otherwise configure) one or more operational settings of the sound processor 68 accordingly.

In turn, at block 88, the hearing prosthesis may thereafter determine as discussed above that the hearing prosthesis should revert to its default sound-processor configuration, i.e., to the sound-processor configuration that the hearing prosthesis had before it changed the sound-processor configuration based on the received control signal. And at block 90, the hearing prosthesis may then responsively reconfigure one or more operational settings of the sound processor to undo the configuration that it made based on the control signal from the external device.

Exemplary embodiments have been described above. It should be understood, however, that numerous variations from the embodiments discussed are possible, while remaining within the scope of the invention.

What is claimed is:

1. A method comprising:

receiving by a hearing prosthesis, from a device external to the hearing prosthesis, both audio content outputted by the device external to the hearing prosthesis and configurable prosthesis data outputted by the device external to the hearing prosthesis, the configurable prosthesis data being data usable by the prosthesis to configure itself to operate in a given manner;

responsive to receipt of the configuration data, the hearing prosthesis automatically configuring a sound processor of the hearing prosthesis in a manner based at least in part on the configurable prosthesis data.

2. The method of claim 1, wherein:

the configurable prosthesis data is prosthesis control data; and the prosthesis is controlled by the control data to configure itself for operation applicable to the received audio content relative to operation which would be the case for different received audio content.

3. The method of claim 1, wherein:

the configurable prosthesis data provides the prosthesis with an indication of at least one characteristic of the audio content; and the action of automatically configuring the sound processor includes automatically configuring the sound processor in a manner based at least in part on the control signal indicating the at least one characteristic of the audio content being output by the device external to the hearing prosthesis.

4. The method of claim 1, wherein receiving the audio content from the device external to the hearing prosthesis comprises receiving the audio content through radio-frequency data communication from the device external to the hearing prosthesis, and wherein receiving the configurable prosthesis data from the device external to the hearing prosthesis comprises receiving the configurable prosthesis data through radio-frequency data communication from the device external to the hearing prosthesis.

5. The method of claim 1, wherein the audio content and configurable prosthesis data are separate from each other, and wherein the receiving of the configurable prosthesis data is separate from the receiving of the audio content.

6. The method of claim 1, wherein the audio content and configurable prosthesis data are integrated together, and wherein the receiving of the configurable prosthesis data is integrated with the receiving of the audio content.

7. The method of claim 1, wherein receiving the audio content from the device external to the hearing prosthesis comprises receiving the audio content at a microphone of the hearing prosthesis, wherein the received audio content comprises sound output from a speaker of the device external to the hearing prosthesis.

8. The method of claim 3, wherein the at least one characteristic of the audio content comprises a particular dynamic range of the audio content, wherein automatically configuring the sound processor of the hearing prosthesis based at least in part on the configurable prosthesis data comprises:

based at least in part on the at least one characteristic of the audio content, automatically configuring a gain-tracking speed level for automatic gain control.

9. The method of claim 3, wherein the at least one characteristic of the audio content comprises the audio content including latency-sensitive audio content, and wherein automatically configuring the sound processor of the hearing prosthesis based at least in part on the at least one characteristic of the audio content comprises:

based at least in part on the audio content comprising latency-sensitive audio content, automatically adjusting at least one sound processor setting to reduce latency of sound processing.

10. The method of claim 1, wherein the audio content comprises the audio content including voice call audio, and wherein automatically configuring the sound processor of the hearing prosthesis based at least in part on the configurable prosthesis data comprises:

based at least in part on the configurable prosthesis data, automatically setting the sound processor to apply a band-pass filter associated with a speech frequency range.

11. The method of claim 3, wherein the at least one characteristic of the audio content comprises the audio content being encoded with a particular codec, and wherein automatically configuring the sound processor of the hearing prosthesis based at least in part on the configurable prosthesis data comprises a function selected from the group consisting of:

based at least in part on the configurable prosthesis data indicating that the audio content is encoded with the particular codec, automatically setting the sound processor to apply a particular band-pass filter, and based at least in part on the configurable prosthesis data indicating that the audio content is encoded with the particular codec, automatically modifying an extent of digital signal processing.

12. A method comprising:

receiving into a hearing prosthesis, from a device external to the hearing prosthesis associated with a recipient of the hearing prosthesis, a control signal including data correlated to one or more characteristics of output audio content of the device; and responsive to receipt of the control signal, the hearing prosthesis automatically configuring itself based at least in part on the control signal.

13. The method of claim 12, wherein:

the control signal specifies one or more characteristics of audio content being output by the device external to the hearing prosthesis; and the method further comprises, prior to the automatic configuration, determining from the control signal one or more characteristics of the audio content being output by the device external to the hearing prosthesis.

14. The method of claim 13, wherein the one or more characteristics of the audio content comprise a particular dynamic range of the audio content, wherein automatically configuring the hearing prosthesis based at least in part on the determined one or more characteristics of the audio content comprises:

based at least in part on the determined one or more characteristics including that the audio content has the particular dynamic range, automatically configuring a gain-tracking speed level for automatic gain control.

15. The method of claim 13, wherein the one or more characteristics of the audio content comprise the audio content including latency-sensitive audio content, and wherein automatically configuring the hearing prosthesis based at least in part on the determined one or more characteristics of the audio content comprises:

based at least in part on determined one or more characteristics including that the audio content comprising latency-sensitive audio content, automatically adjusting at least one prosthesis setting to help reduce latency of sound processing by the prosthesis.

16. The method of claim 12, wherein:

the control signal specifies one or more characteristics of audio content being output by the device external to the hearing prosthesis.

17. The method of claim 12, further comprising:

responsive to a user input, overriding the control signal.

18. A hearing prosthesis comprising:

at least one microphone for receiving audio; and a sound processor for processing the audio and generating corresponding hearing stimulation signals to stimulate hearing in a human recipient of the hearing prosthesis, wherein the hearing prosthesis is configured to receive, relative to the hearing prosthesis, a remotely generated signal correlated to the audio but of prosthesis operation content, and to respond to the received signal by automatically configuring the sound processor in a manner based at least in part on the signal.

19. The hearing prosthesis of claim 18, wherein:

the prosthesis operation content is an attribute of the audio; and the prosthesis is configured to evaluate the attribute to automatically configure the sound processor in a manner based at least in part on the attribute.

20. The hearing prosthesis of claim 18, wherein:

the prosthesis is configured to analyze the prosthesis operation content to identify a characteristic of the audio and automatically configure the sound processor in the manner based at least in part on the analysis.

21. The hearing prosthesis of claim 18, wherein:

the prosthesis is configured to analyze the prosthesis operation content to identify a characteristic of the audio and automatically configure the sound processor in the manner based at least in part on the analysis; and the hearing prosthesis is configured to receive input from a recipient of the hearing prosthesis and override the automatic configuration of the sound processor that results from the response to the received signal.

22. The hearing prosthesis of claim 18, wherein:

the prosthesis is configured to analyze the prosthesis operation content and automatically configure the sound processor in the manner based at least in part on the analysis.

23. The method of claim 1, wherein:

the action of receiving by the hearing prosthesis, from the device external to the hearing prosthesis, both audio content outputted by the device external to the hearing prosthesis and configurable prosthesis data outputted by the device external to the hearing prosthesis is executed a plurality of different times, wherein the configurable prosthesis data is respectively different and based on the specific respective audio content outputted by the device.

24. The method of claim 1, further comprising:

receiving by the hearing prosthesis, from the device external to the hearing prosthesis, both second audio content outputted by the device external to the hearing prosthesis and second configurable prosthesis data outputted by the device external to the hearing prosthesis, the second configurable prosthesis data being data usable by the prosthesis to configure itself to operate in a second given manner, wherein the second audio content follows the first audio content in a manner that corresponds to normal everyday use of the hearing prosthesis;

responsive to receipt of the second configuration data, the hearing prosthesis automatically configuring the sound processor of the hearing prosthesis in a second manner based at least in part on the second configurable prosthesis data.

25. The method of claim 1, wherein the action of the hearing prosthesis automatically configuring the sound processor of the hearing prosthesis in the manner based at least in part on the configurable prosthesis data is executed by the hearing prosthesis after the hearing prosthesis has been fitted to a recipient thereof.

26. The method of claim 1, wherein the audio content comprises speech and/or music content.

27. The method of claim 1, further comprising:

processing the audio content via the configured sound processor; and evoking a hearing percept based on the processed audio content, wherein the device external to the hearing prosthesis is a device that is different in type from a second device external to the hearing prosthesis that outputted both audio content outputted and configurable prosthesis data usable by the prosthesis to configure itself to operate in a second given manner that was previously received by the hearing prosthesis.

28. The method of claim 1, wherein the action of responsive to receipt of the configuration data, the hearing prosthesis automatically configuring the sound processor of the hearing prosthesis in the manner based at least in part on the configurable prosthesis data is executed without fitting the hearing prosthesis to the recipient of the hearing prosthesis.

29. The method of claim 1, wherein the action of receiving by the hearing prosthesis the audio content and the configurable prosthesis data is executed during normal everyday use of the prosthesis.

30. The method of claim 1, further comprising:

receiving by the hearing prosthesis, from a second device external to the hearing prosthesis of a different type than the device external to the hearing prosthesis, both second audio content outputted by the second device external to the hearing prosthesis and second configurable prosthesis data outputted by the second device external to the hearing prosthesis, the second configurable prosthesis data being data usable by the prosthesis to configure itself to operate in a second given manner, wherein the second audio content follows the first audio content, wherein the external device is a television and the second external device is a consumer electronics product that is different than a television.

31. The method of claim 12, further comprising:

responsive to a user input into the hearing prosthesis and/or the external device, overriding the control signal.

32. The hearing prosthesis of claim 18, wherein:

the hearing prosthesis is configured to receive input from a recipient of the hearing prosthesis and override the automatic configuration of the sound processor that results from the response to the received signal.

33. The method of claim 12, wherein:

the control signal included data correlated to one or more characteristics of audio content being output by the device external to the hearing prosthesis.

34. The hearing prosthesis of claim 18, wherein:

the prosthesis is configured to receive audio content via a radio-frequency data communication; and the prosthesis is configured to receive the remotely generated signal correlated to the audio via a radio-frequency data communication.

35. The hearing prosthesis of claim 18, wherein:

the hearing prosthesis is configured to receive, from a plurality of different types of devices external to the hearing prosthesis, respective audio content and configurable prosthesis data, the configurable prosthesis data being data usable by the prosthesis to configure itself to operate in a given manner; and the hearing prosthesis is configured to, responsive to receipt of the configuration data, automatically configuring the sound processor in a manner based at least in part on the respective received configurable prosthesis data.

* * * * *